US007499063B2

(12) United States Patent
Ishiguchi

(10) Patent No.: US 7,499,063 B2
(45) Date of Patent: Mar. 3, 2009

(54) LIQUID CRYSTAL DISPLAY

(75) Inventor: Kazuhiro Ishiguchi, Kumamoto (JP)

(73) Assignee: Mitsubishi Electric Corporation, Tokyo (JP)

( * ) Notice: Subject to any disclaimer, the term of this patent is extended or adjusted under 35 U.S.C. 154(b) by 803 days.

(21) Appl. No.: 10/671,745

(22) Filed: Sep. 29, 2003

(65) Prior Publication Data

US 2004/0075631 A1 Apr. 22, 2004

(30) Foreign Application Priority Data

Oct. 3, 2002 (JP) ..... P2002-291326

(51) Int. Cl.
*G09G 5/10* (2006.01)

(52) U.S. Cl. ..... 345/690; 345/98; 345/100; 348/671

(58) Field of Classification Search ..... 345/87–102, 345/690, 204, 211
See application file for complete search history.

(56) References Cited

U.S. PATENT DOCUMENTS

| | | | | |
|---|---|---|---|---|
| 6,781,605 | B2 * | 8/2004 | Kudo et al. | 345/690 |
| 6,819,311 | B2 * | 11/2004 | Nose et al. | 345/100 |
| 6,947,034 | B2 * | 9/2005 | Kwon | 345/204 |
| 2001/0003448 | A1 | 6/2001 | Nose et al. | |
| 2003/0095117 | A1 | 5/2003 | Katagawa et al. | |

FOREIGN PATENT DOCUMENTS

| | | |
|---|---|---|
| JP | 7-230073 | 8/1995 |
| JP | 9325715 | 12/1997 |
| JP | 2001-166280 | 6/2001 |
| JP | 2002-175057 | 6/2002 |
| JP | 2003-162256 | 6/2003 |

OTHER PUBLICATIONS

Japanese Office Action issued in corresponding Japanese Patent Application No. JP 2002-291326, dated Nov. 21, 2006.
Japanese Office Action issued in Japanese Patent Application No. JP 2002-291326, mailed Nov. 20, 2007.

* cited by examiner

*Primary Examiner*—Duc Q Dinh
(74) *Attorney, Agent, or Firm*—McDermott Will & Emery LLP

(57) ABSTRACT

A reference voltage generator circuit is arranged to generate a reference voltage including an image display voltage for outputting an image write voltage and a black display voltage for outputting a black write voltage. When the reference voltage generator circuit switches a reference voltage to either of the voltages, supplying the voltage to a signal line drive IC, and outputs the voltage as the image write voltage or the black write voltage from the signal line drive IC to a liquid crystal panel, the reference voltage is switched so that an image display period for supplying the image display voltage and a black display period for supplying the black display voltage are contained during one horizontal period, and the switching is synchronized with a change in selection line control signals 502, 503, 504 of lines in which an image is written and lines in which black is written for a selection line 101.

9 Claims, 12 Drawing Sheets

LIQUID CRYSTAL DISPLAY

BACKGROUND OF THE INVENTION

1. Field of the Invention

The present invention relates to an active matrix-type liquid crystal display improved in visibility of displayed moving images.

2. Description of the Related Art

A liquid crystal display generally performs hold-type drive as described in, for example, the Japanese Patent Publication (unexamined) No. 1997-325715 (paragraph No. 0002). Due to this drive, a phenomenon that a fuzzy image is observed occurs when a moving image is displayed.

Therefore several attempts for improving the display in visibility have been proposed such as turning on and off a light source or black display is produced in the display image for a certain period of time.

In the method of producing black display in the display image for a certain period, if black display is inserted each frame, this method has disadvantages such as occurrence of flickers and thinning in amount of image that can be displayed in view of time. In another method of performing scanning at a double speed, a high-speed control signal is required, and circuit arrangement scale becomes large.

In a driving method disclosed in the Japanese Patent Publication (unexamined) No. 2001-166280 (paragraph Nos. 0023 to 0029, FIG. 1 ), an image display period and a black display period are constant for every line (row). Accordingly the observed image is high in screen uniformity and, further more, since it is possible to use a conventional TFT wiring as it is, there is an advantage of suppressing decrease in open area ratio and increase in circuit scale. However, for achieving this method, in the case where, for example, black data are inputted to a signal line drive circuit to output a black voltage, a very large-scale circuit is required in order to input both data signal and black signal within one horizontal time.

SUMMARY OF THE INVENTION

The present invention was made to solve the above-discussed problems and has an object of obtaining a liquid crystal display, in which black display is produced in display image for a certain period of time with a simple circuit arrangement utilizing generally known signal line drive IC and selection line signal output IC.

A liquid crystal display according to the invention includes: a liquid crystal panel having a large number of picture elements arranged at intersections of plural selection lines and data lines; a selection line signal output IC for outputting a selection line signal to the selection lines of the liquid crystal panel; a signal line drive IC for outputting an image write voltage and a black write voltage to the data line of the liquid crystal panel; and a reference voltage generator circuit, which is arranged so as to generate a reference voltage including an image display voltage for outputting an image write voltage and a black display voltage for outputting a black write voltage, switches over the reference voltage either to the mentioned image display voltage or to the mentioned black display voltage, and supplies the reference voltage to the signal line drive IC. In this liquid crystal display, switching the reference voltage is performed so that an image display period for supplying the mentioned image display voltage and a black display period for supplying the black display voltage are contained in one horizontal period, and the switching the reference voltage is synchronized with change in selection line signals of lines (rows) in which an image is written and lines (rows) in which black is written.

As a result, black display is produced in the display image for a certain period of time with a simple circuit arrangement in which a general signal line drive IC and a selection line signal output IC are used. Thus it is possible to obtain an image of high screen uniformity.

DESCRIPTION OF THE PREFERRED EMBODIMENTS

Embodiment 1

Figure 1:
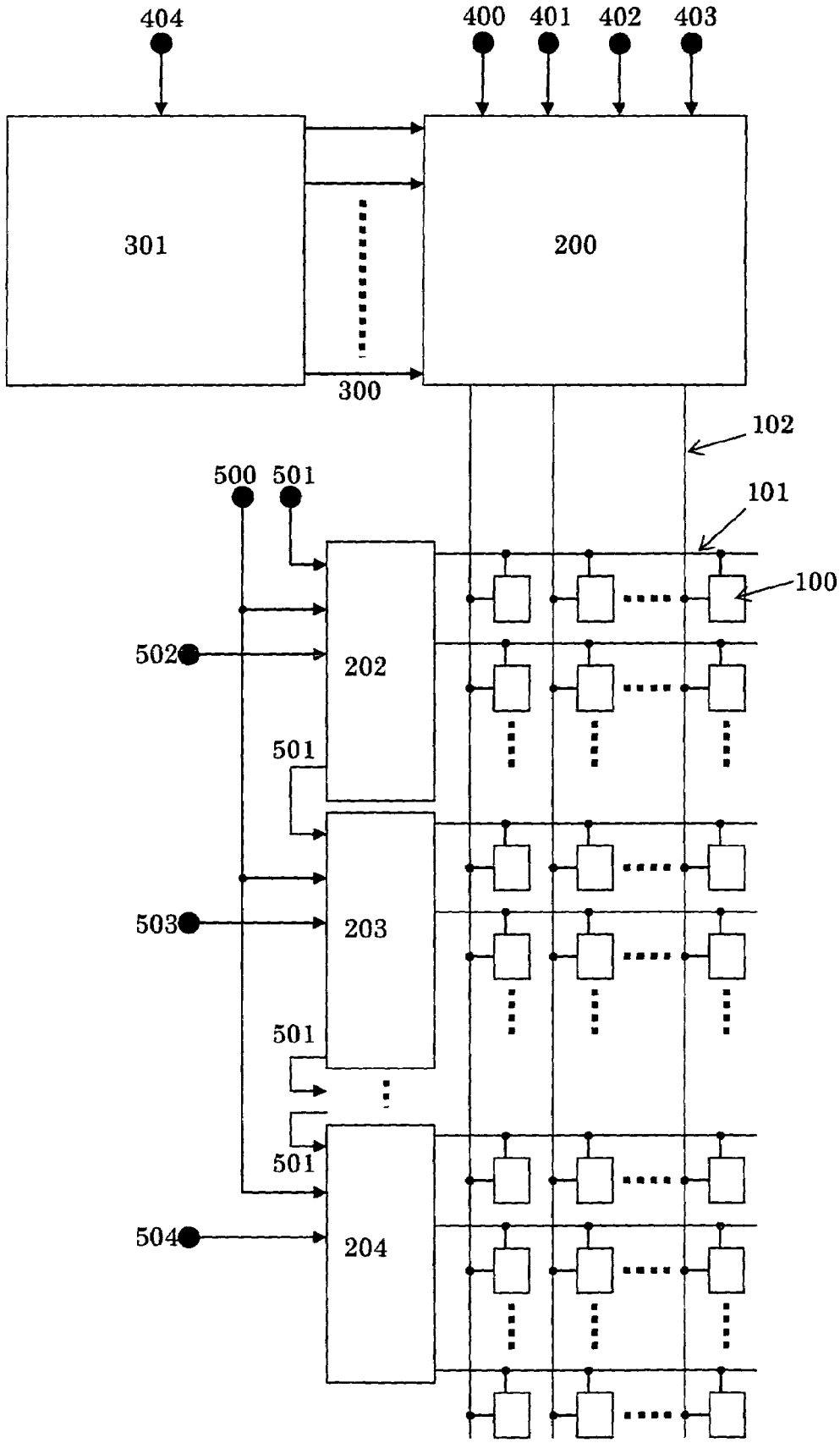
FIG. 1 is a block diagram showing a liquid crystal display according to Embodiment 1 of the present invention.

FIG. 1 is a block diagram showing a liquid crystal display according to Embodiment 1 of the invention.

Referring to FIG. 1, the liquid crystal display has nH picture elements 100 arranged in horizontal direction and nV picture elements in vertical direction. Each picture element is connected to one selection line 101 and one data line 102. n general, the data line 102 is connected to plural signal line drive ICs 200, and the signal line drive ICs 200 are driven by an image data signal 400, a horizontal clock 401, an output latch pulse 402, other control signal 403, and plural reference voltages 300. The reference voltages 300 are outputted from a reference voltage generator circuit 301 that switches a voltage to an image display voltage or to a black display voltage in accordance with a black voltage selection signal 404. Each selection line 101 is connected to a selection line signal output ICs 202, 203, or 204, and each selection line signal output IC outputs signals to nG selection lines. A selection line clock signal 500 is inputted to the selection line signal output ICs 202, 203 and 204, and a selection line start pulse 501 is inputted to the selection line signal output IC 202. The selection line start pulse 501 is cascade-connected so as to be inputted to the next selection line signal output IC 203. Selection line control signals 502, 503 and 504 are independently inputted to the selection line signal output ICs 202, 203 and 204 respectively.

Figure 2:
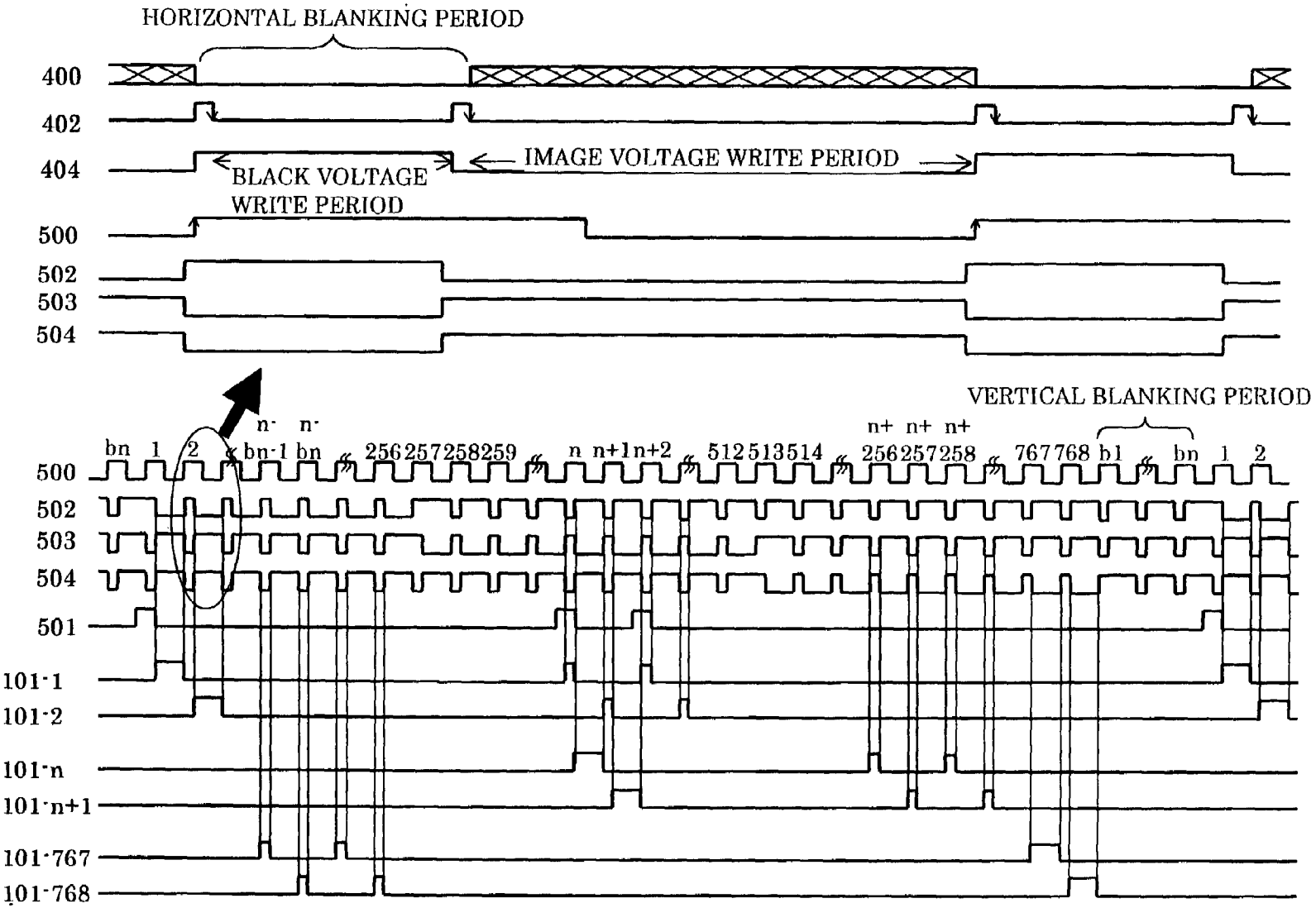
FIG. 2 is a timing chart of each signal of the liquid crystal display according to Embodiment 1 of the invention.

FIG. 2 is a timing chart of each signal of the liquid crystal display according to Embodiment 1 of the invention.

Figure 3:
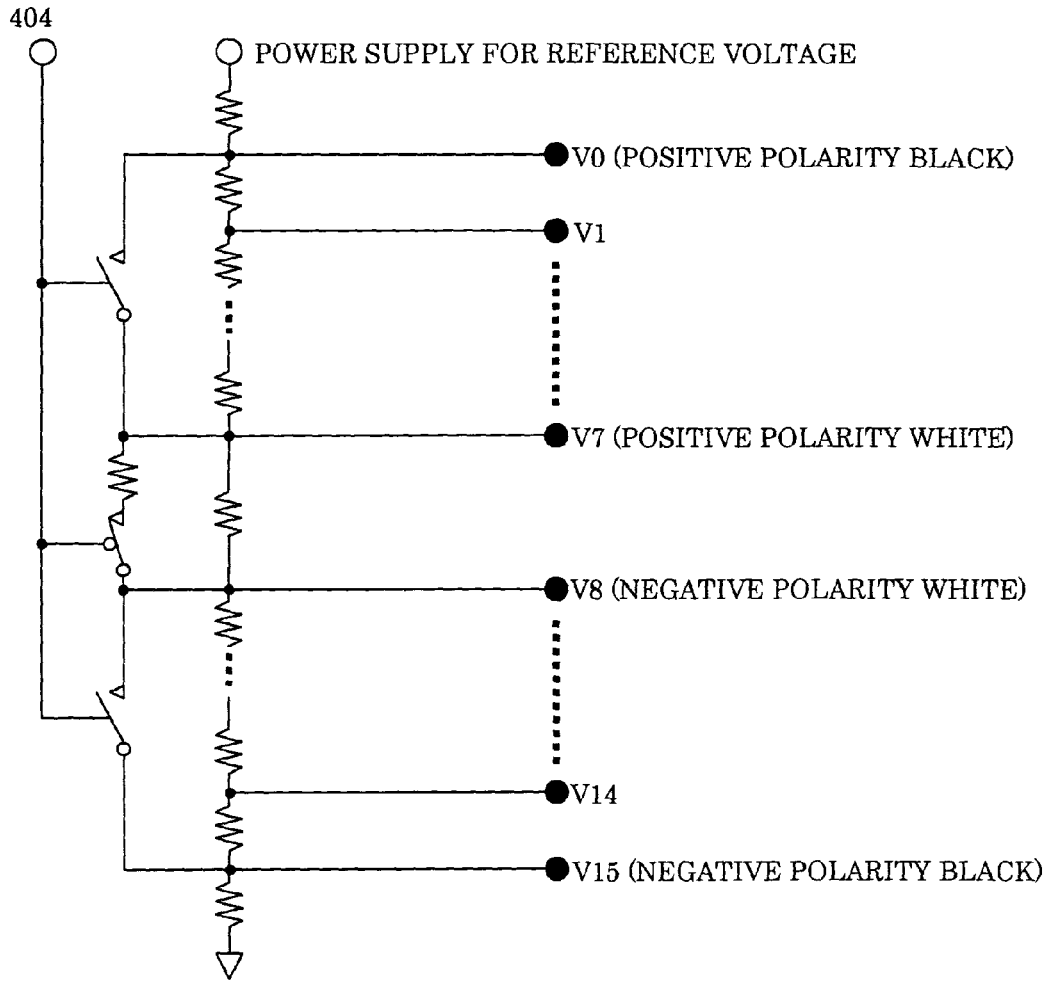
FIG. 3 is a circuit diagram showing a reference voltage generator circuit of a normally white liquid crystal display according to Embodiment 1 of the invention.

FIG. 3 is a circuit diagram showing a reference voltage generator circuit of a normally white liquid crystal display according to Embodiment 1.

Referring to FIG. 3, the circuit is comprised of resistors connected in series, and resistance value of the resistors is changed by switching elements connected in series or in parallel to the resistors. V0 indicates a voltage of positive polarity black, V7 indicates a voltage of positive polarity white, V8 indicates a voltage of negative polarity white, and V15 indicates a voltage of negative polarity black.

Figure 4:
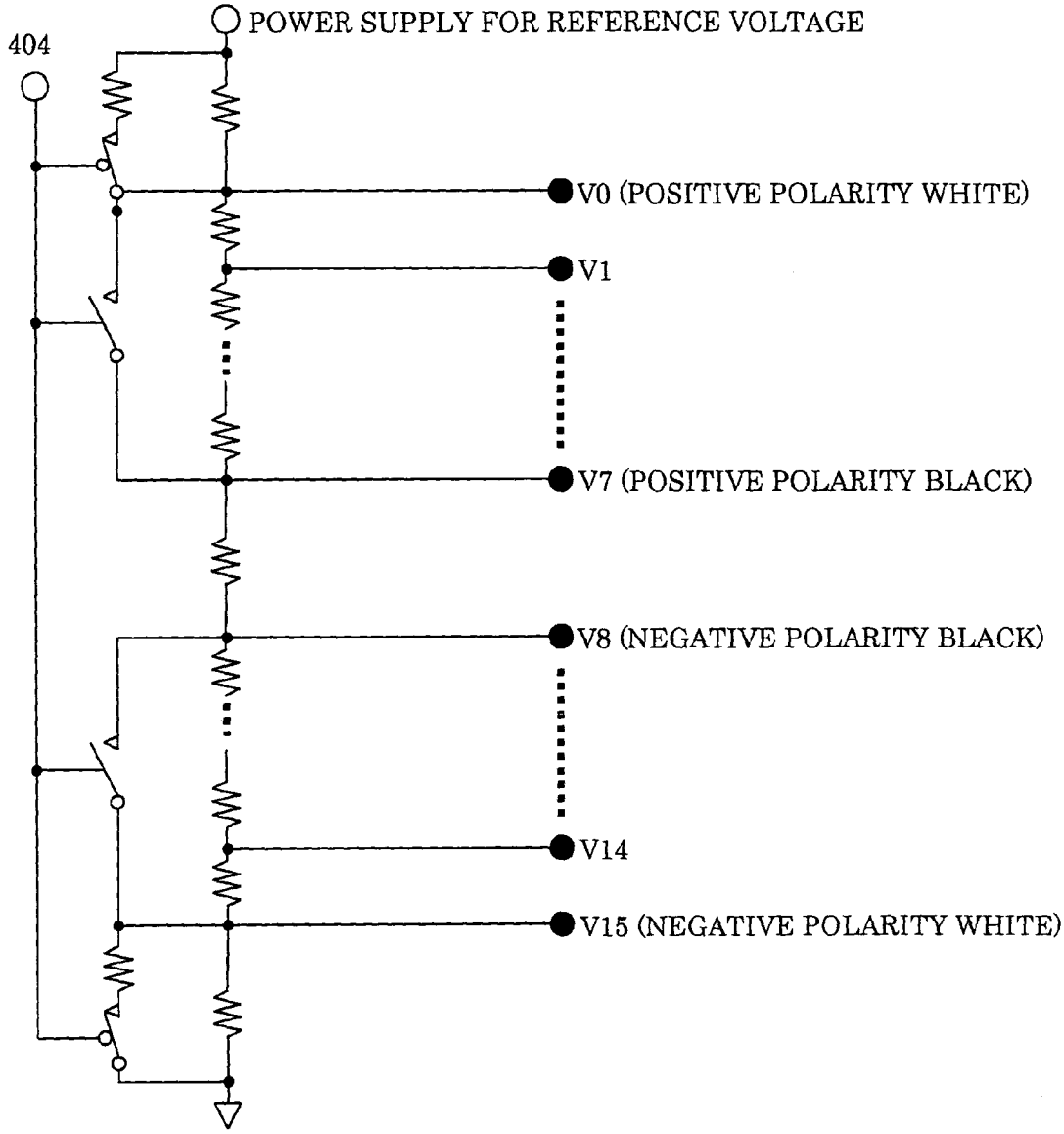
FIG. 4 is a circuit diagram showing a reference voltage generator circuit of a normally black liquid crystal display according to Embodiment 1 of the invention.

FIG. 4 is a circuit diagram showing a reference voltage generator circuit of a normally black liquid crystal display according to Embodiment 1 of the invention.

Referring to FIG. 4, the circuit is comprised of resistors connected in series, and resistance values of the resistors are changed by switching elements connected in series or in parallel to the resistors. V0 indicates a voltage of positive polarity white, V7 indicates a voltage of positive polarity black, V8 indicates a voltage of negative polarity black, and V15 indicates a voltage of negative polarity white.

Figure 5:
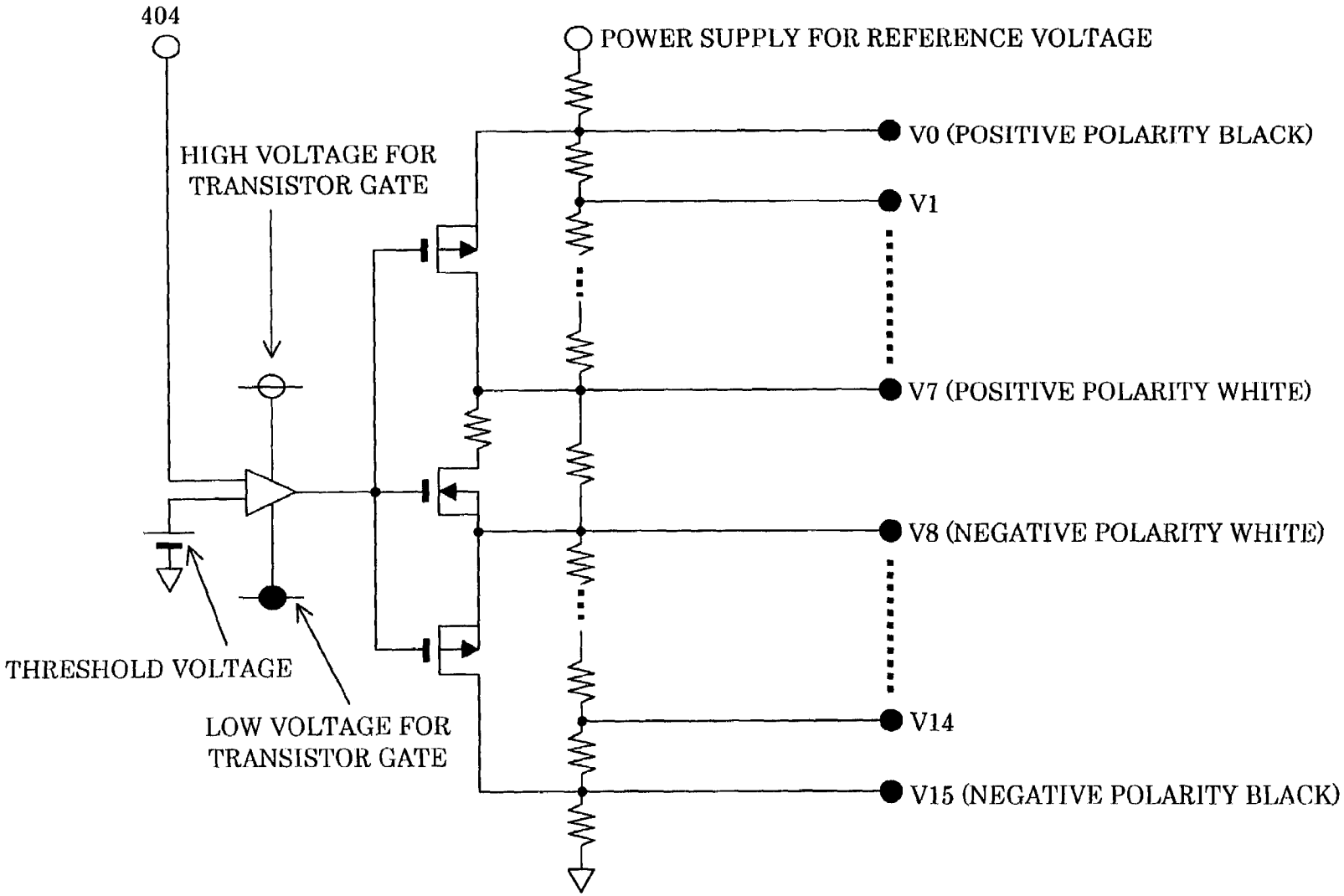
FIG. 5 is a circuit diagram showing a reference voltage generator circuit in which a switching part of the normally white liquid crystal display according to Embodiment 1 of the invention is comprised of a transistor.

FIG. 5 is a circuit diagram showing a reference voltage generator circuit in which a switching part of the normally white liquid crystal display according to Embodiment 1 of the invention is comprised of a transistor.

Referring to FIG. 5, the circuit is comprised of resistors connected in series, and resistance values of the resistors are changed by switching elements connected in series or in parallel to the resistors. V0 indicates a voltage of positive polarity black, V7 indicates a voltage of positive polarity white, V8 indicates a voltage of negative polarity white, and V15 indicates a voltage of negative polarity black.

Figure 6:
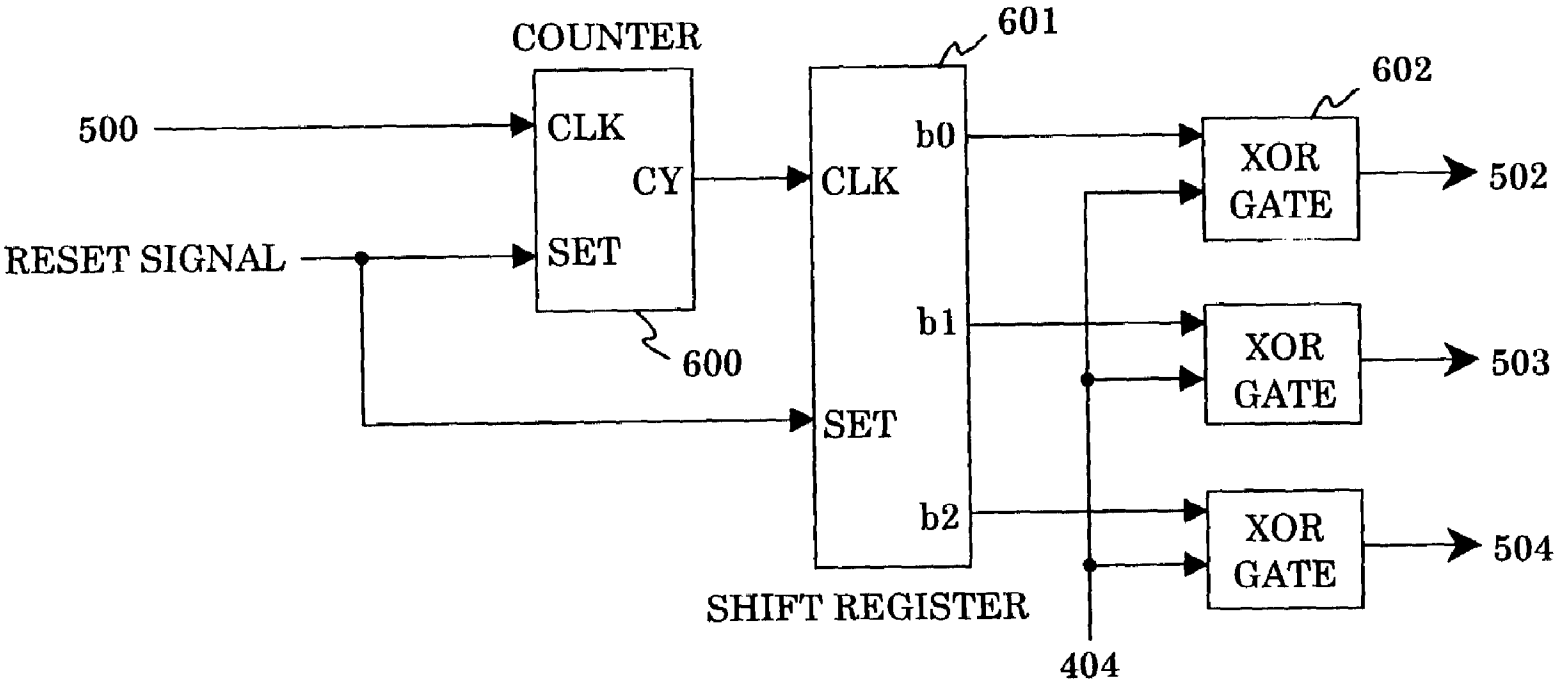
FIG. 6 is a diagram showing a circuit for generating an output valid signal of a selection line signal output IC of the liquid crystal display according to Embodiment 1 of the invention.

FIG. 6 is a diagram showing a circuit for generating an output valid signal of a selection line signal output IC of the liquid crystal display according to Embodiment 1 of the invention.

Referring to FIG. 6, the selection line clock signal 500 and a reset signal are inputted to a counter 600, and an output of the counter 600 and the reset signal are inputted to a shift register 601. An output of the shift register 601 and the black voltage selection signal 404 are inputted to plural XOR gates 602 corresponding to the selection line control signals 502, 503 and 504, and the selection line control signals 502, 503 and 504 are outputted from the respective XOR gates 602.

Figure 7:
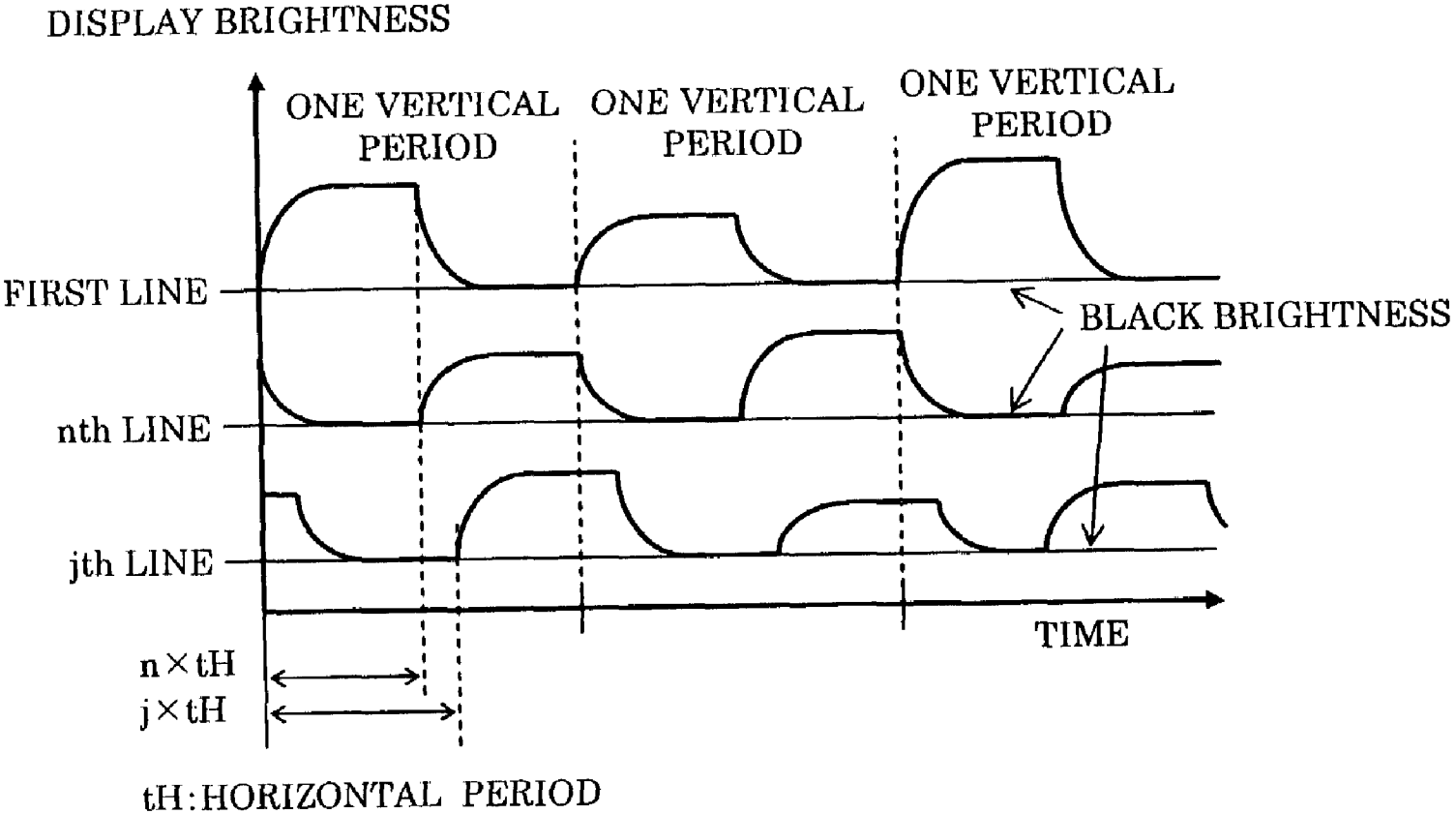
FIG. 7 is a graphic diagram showing display effect of the liquid crystal display according to Embodiment 1 of the invention.

FIG. 7 is a graphic diagram showing display effect of the liquid crystal display according to Embodiment 1 of the invention.

Figure 8:
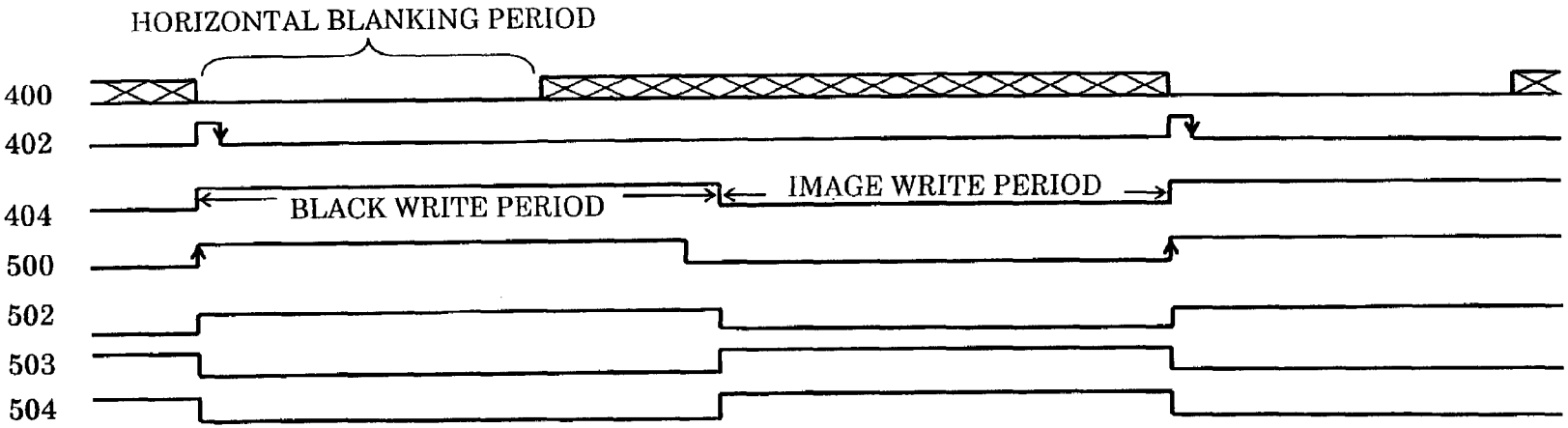
FIG. 8 is a timing chart showing a case where the display is switched from black display to image display or from image display to black display during data loading period of the liquid crystal display according to Embodiment 1 of the invention.

FIG. 8 is a timing chart showing a case where the display is switched from black display to image display or from image display to black display during data loading period of the liquid crystal display according to Embodiment 1 of the invention.

Figure 9:
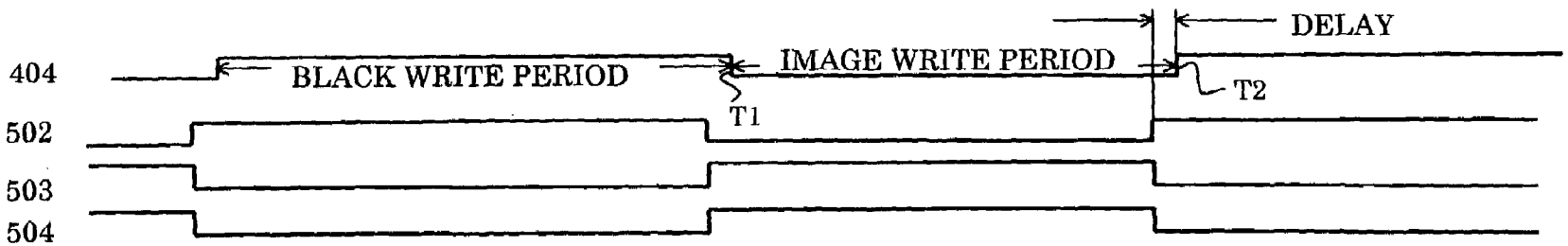
FIG. 9 is a timing chart showing a case where delay in transmission of the selection line signal of the liquid crystal display according to Embodiment 1 of the invention is taken into consideration.

FIG. 9 is a timing chart showing a case where delay in transmission of the selection line signal of the liquid crystal display according to Embodiment 1 of the invention is taken into consideration.

The reference voltage generator circuit 301, which switches a voltage to the image display voltage or to the black display voltage in accordance with the black voltage selection signal 404, is easily manufactured with the circuit as shown in FIG. 3 or FIG. 4. The switching part of the reference voltage generator circuit 301 can be manufactured at a reasonable cost with, for example, a P-channel and N-channel small signal transistor as shown in FIG. 5.

By changing the reference voltages in such a manner as described above, whatever data is inputted to the signal line drive ICs 200, the signal line drive ICs 200 can output black write voltages. Consequently any large-scale circuit arrangement for carrying out special signal processing of the image data signals for black write is not required.

Furthermore, by appropriately selecting a resistance value of the connected resistors, the black write voltage applied to the liquid crystal is easily set to a voltage different from the black voltage of a normal image write voltage.

It is possible to arrange the reference voltage generator circuit 301 to change the reference voltage by using a semiconductor device capable of generating a voltage of any arbitrary value based on an inputted signal such as digital-to-analog (D/A) converter, thereby changing the input signal. In such an arrangement, the circuit arrangement becomes more complicated than the foregoing ones.

Now, the timing chart in FIG. 2 is hereinafter explained.

FIG. 2 shows a timing chart of a signal in the case where nV =768 and nG=256, i.e., in the case where three selection line signal output ICs are arranged. It is supposed that each selection line 101 is turned on when the selection line clock signal 500 rises and, at this stage, the selection line 101 selected in the previous stage is turned off. It is also supposed that each selection line 101 is turned on when the selection line control signals 502, 503, or 504 inputted to the selection line signal output IC 202, 203, or 204, to which the mentioned selection line is connected, is at a low level and is turned off when the selection line control signal is at a high level. It is further supposed that the signal line drive ICs 200 start to output when the output latch pulse 402 falls and continues to output while the output latch pulse 402 being at a low level. It is furthermore supposed that the reference voltage generator circuit 301 outputs a black display voltage when the black voltage selection signal 404 is at a high level and outputs an image display voltage when the black voltage selection signal 404 is at a low level.

In this Embodiment 1, after the image data 400 are loaded in the signal line drive ICs 200, the black voltage selection signal 404 is switched to a high level and the output latch pulse 402 is to a low level. As a result, it becomes possible to output the black write voltage from the signal line drive ICs 200.

By switching the black voltage selection signal 404 to a low level and the output latch pulse 402 to a low level again before data of the next line comes, the signal line drive ICs 200 can output an image write voltage. In other words, as shown in FIG. 2, the voltage is switched from the image display voltage to the black display voltage or from the black display voltage to the image display voltage during horizontal blanking period. During this horizontal blanking period, no image data 400 are loaded in the signal line drive ICs 200.

Subsequently to a data write pulse, a black write pulse is outputted to the selection line start pulse 501 on and after nG (256 in this example) selection line clocks 500. The black write pulse is outputted after n lines in this example.

Referring now to FIG. 6, a signal, which is switched to a low level when an image write voltage is selected for the data line 102 and to a high level when a black write voltage is selected, i.e., the black voltage selection signal 404 in this example, is inputted to only those among the selection line signal output ICs 202, 203 and 204 during a period nGTH from input of the selection line start pulse to a time obtained by multiplying an output number nG of the selection line signal output IC by a selection line clock period TH. Any inverted signal of the mentioned signal is inputted to the rest of the selection line signal output ICs being out of this period nGTH. The selection line control signals 502, 503, and 504 are formed in the mentioned manner.

The selection line control signals 502, 503 and 504 can be easily achieved by, for example, connecting each of the selection line control signal 502, 503 and 504 to an exclusive disjunction (XOR) gate output, inputting the black voltage selection signal 404 to one end of the XOR gate 602, and connecting each bit output of the shift register 601 for carrying out bit shift based on the counter 600 output to another end of the XOR gate 602 as shown in FIG. 6.

In the example shown in FIG. 6, when the reset signal is inputted, the counter 600 is reset, and binary "110" is inputted to the shift register 601. At this point of time, the black voltage selection signal 404 is outputted to the selection line control signal 502, and an inverted signal of the black voltage selection signal 404 is outputted to the selection line control signals 503 and 504. When the counter 600 is counted up by the selection line clock 500 and reaches a set value, a carry flag is outputted, and the value of the shift register 601 becomes binary "101". In this case, the black voltage selection signal 404 is outputted to the selection line control signal 503, and an inverted signal of the black voltage selection signal 404 is outputted to the other control signals.

Thus, when the image write voltage is outputted to the data line 102, the selection line 101 of the lines where black is displayed is in a non-selective state, and only the selection line of the lines where the image write voltage is written is in a selective state. On the other hand, when the selection line of the lines where black is written is in a selective state, the line where the data are written is in a non-selective state. Therefore, synchronizing the black display voltage output period and the data voltage output period with the selection line control signals 502, 503, and 504 makes it possible to write the black write voltage and the image write voltage in different lines during one horizontal period.

During the period of black write after n limes from writing the image, the picture elements display the image in accordance with the data. If this period of time is too short, the contrast is lowered and the image as a whole becomes dark. On the other hand, if this period of time is too long, visibility of a moving image is lowered due to the hold type. In this Embodiment 1, the period of time until the black write voltage is written after the image write voltage is written is freely adjustable within a range on and from nGth line to total number of lines+vertical blanking period−nG−black write selection line start pulse period. Therefore it is possible to adjust and optimize this tradeoff. It is further also possible to arbitrarily adjust this time conforming to the display image.

Display effect according to Embodiment 1 is shown in FIG. 7. As for the picture elements on the first line, display image is written on the picture elements in the beginning of one vertical period, and black image is written after n lines have passed. As for the picture elements on the nth line, display image is written on the picture elements after scanning from the first line to the n-1th line has passed, and black image is written after scanning of n lines. This period from the time when the display image has been written to the time when the black image has been written is constant through all the lines, and it is possible to obtain a display that is uniform on the screen. The displayed image is sufficiently faster than the speed observed by human eye and does not flicker. Further, amount of information displayed during a certain period of time is the same as that of the inputted data.

In the timing shown in FIG. 2, the reference voltage is switched using the data output latch pulse 402. In the case of any generally known signal line drive IC 200, this data output latch pulse 402 can not apply to signal line drive IC 200 during loading the image data, and therefore it is necessary to generate this data output latch pulse 402 twice during horizontal blanking period thereby switching the voltage from the image display voltage to the black display voltage and from the black display voltage to the image display voltage.

However, in the case of a very short image signal in the horizontal blanking period, the black charging time becomes extremely short, and the voltage may be switched before the transistor of the picture elements is turned on in an extreme case. In such a case, no matter how many times black are written, there is no use in writing black.

The problem described above is solved by the method shown in FIG. 8 in which reference voltage is switched during the period when the image data is loaded into the signal line drive IC.

Specifically, in the method of FIG. 8, it is possible to switch the black voltage selection signal 404 and the selection line control signals 502, 503, and 504 to a black voltage write state and an image voltage write state at any time. Thus it is possible to arbitrarily adjust the period conforming to the charging characteristic of the picture elements.

There may be some cases in which it is impossible to switch the reference voltage at the timing shown in FIG. 8 depending upon the constitution of the signal line drive IC. It is certain that D/A converter is normally used in the signal line drive IC, but there are various types of internal arrangements. In an internal arrangement in which the signal line output is directly connected (through internal series resistors) to the reference voltage in voltage-follower connection, the signal line output varies by changing the reference voltage. In such an arrangement, either method of FIG. 2 or 8 can achieve switching the voltage.

However, in the signal line drive IC of an arrangement, in which reference voltage is sampled and another circuit keeps the voltage, there is no connection to the reference voltage during the period when the signal line voltage is outputted after sampling the reference voltage. Therefore, variation in reference voltage is not reflected on the output, and in this case, the signal line drive IC can be operated only at the timing of FIG. 2.

In the case where there is any delay in transmission of the selection line signal between the picture elements on the same selection line, if switching simultaneously the selection line control signal and the reference voltage selection signal, the next reference voltage may be written before transmission of the selection line signal to the picture elements, resulting in undesirable influence on the display image. To overcome this problem, it is preferable that the selection line control signal is switched from a valid state to an invalid state before switching the reference voltage as shown in FIG. 9.

Referring to FIG. 9, supposing that the reference voltage generator circuit switches the voltage from the black display voltage to the image display voltage at time T1 and switches the voltage from the image display voltage to the black display voltage at time T2, it is arranged that line selected at time (T2−T1)/2 are turned into a non-selective state at a time later than (T2−T1)/2 and earlier than T2.

In the actual circuit arrangement, the black voltage selection signal that has passed through a delay circuit and the selection line control signal that has not passed through the delay circuit yet are used as the signals inputted to the reference voltage generator circuit.

In the case where the black voltage write period is short and the picture elements are not sufficiently charged, it is possible to change the picture element voltage to a value sufficient for black display by inputting several selection line start pulses for black write and writing the black voltage several times. However, in the case where the picture elements on the same line in every selection line are different in terms of applied voltage polarities, it is preferable that the start pulse is inputted to every other selection line. In this case, if the selection lines in which black is going to be written are made valid before switching the reference voltage to black, the image display voltage is once written when black is written on and after the second time during one frame period. If this brings an influence to the display such as lack in uniformity on the screen, the timing for making valid the selection line valid signal for writing black is adjusted to be delayed, thereby the problem being overcome.

In this Embodiment 1, it is easy to make different the black voltage for the image display voltage and the black display voltage from each other. Accordingly it is possible to adjust these voltages so as to attain any target picture element voltage upon one charging time. For example, it is preferable to set an absolute value for the voltage applied to the liquid crystal to be high, in the case of normally white type liquid crystal display, while setting an absolute value to be low in the case of a normally black type liquid crystal display.

At the time of writing the black write voltage and the image write voltage, if period for the writing is short and it is not possible to attain a target voltage of the selection line, the voltage in selective state is made sufficiently high for achieving the target value within such period, thereby such a problem being overcome.

According to Embodiment 1, it is possible to establish black display on the display image for a certain period of time with a simple circuit arrangement utilizing any known signal line drive IC and selection line signal output IC. As a result, it is possible to achieve an image of high screen uniformity.

Embodiment 2

To improve low moving image quality due to the hold type, there is a method in which black display and image display are performed alternately for each frame. However, when a black image is simply inserted at a vertical period of 60 Hz, the black image is recognized as outstanding flicker. This is because the integrated screen brightness repeats brightness and darkness at 30 Hz that is half of 60 Hz. This problem of flicker is solved by performing interlace drive where black is displayed on every other horizontal line or by displaying black and image for every vertically or horizontally neighboring picture elements. Consequently, if the same image signals are inputted, the laminated screen brightness is the same for each frame, and flickers are not recognized.

In the foregoing Embodiment 1, as to a certain picture element, image and black are both displayed in one frame, and therefore it is certain that fewer flickers are recognized and amount of information displayed during a certain period of time becomes double as compared with this system. But, recent years the liquid crystal display has advanced higher in terms of resolution, and in the case of driving a (UXGA) display having 1600×1200 picture elements at a vertical frequency of 60 Hz, one horizontal period is so short as to be approximately 13.3 μs, and quite a very short time is permitted to write the image in the picture elements of the liquid crystal display. In addition, in the method described in the foregoing Embodiment 1, the image write time is shorter than one horizontal period, and therefore it is more realistic to display black for each frame in the case of a high-resolution liquid crystal display.

Figure 10:
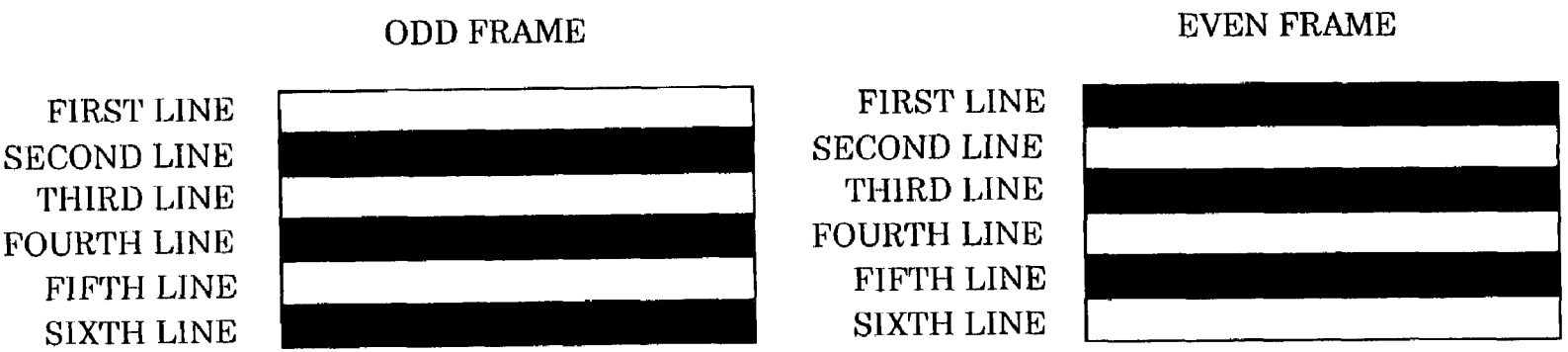
FIG. 10 is a schematic diagram to explain interlace-drive of a general liquid crystal display.

FIG. 10 is a schematic diagram for explaining interlace-drive of a generally known liquid crystal display.

Figure 11:
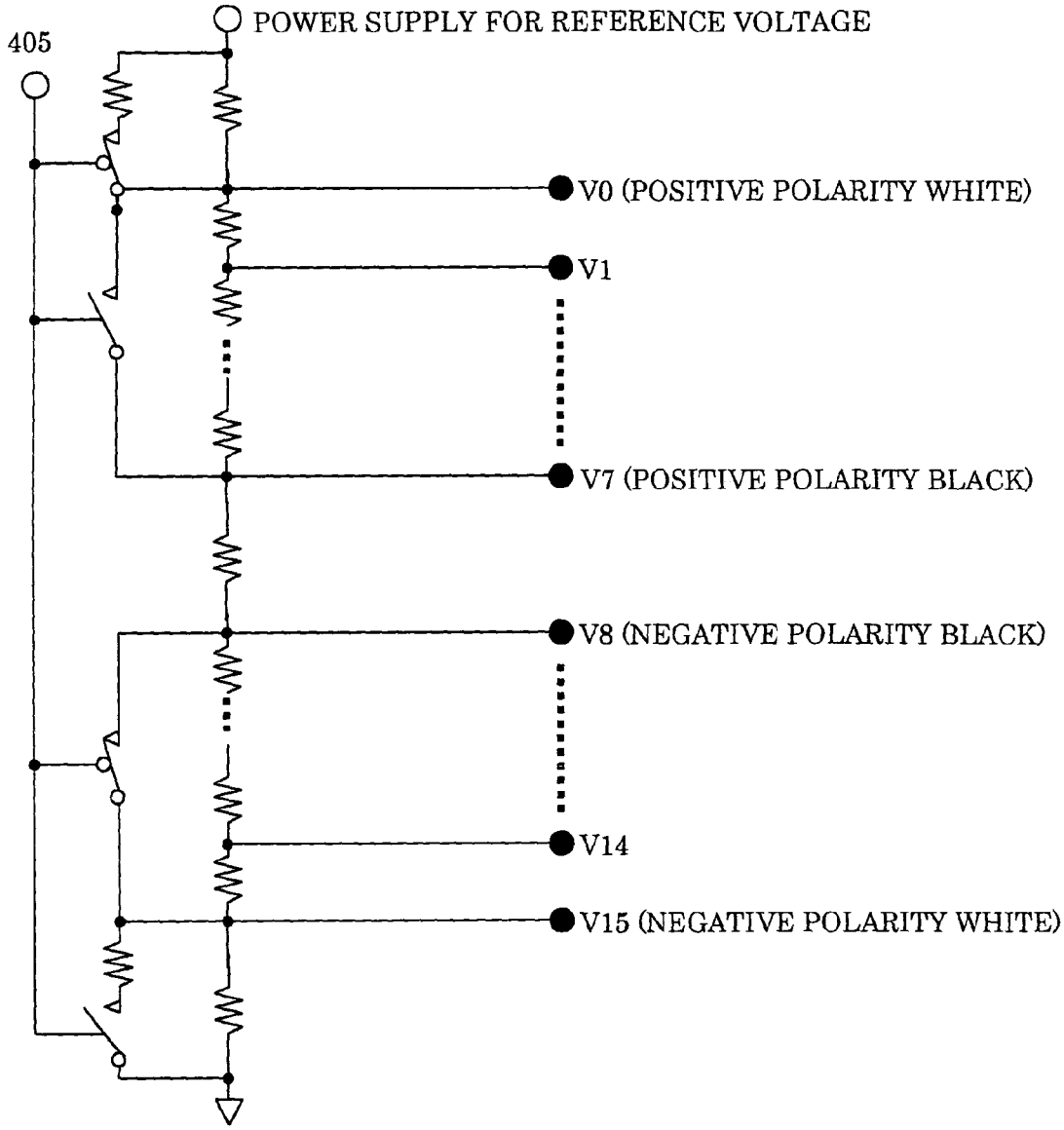
FIG. 11 is a circuit diagram showing a reference voltage generator circuit of a normally black liquid crystal display according to Embodiment 2 of the invention.

FIG. 11 is a circuit diagram showing a reference voltage generator circuit of a normally black liquid crystal display according to this Embodiment 2 of the invention.

Referring to FIG. 11, the circuit is comprised of resistors connected in series, and resistance value thereof is changed by switching elements connected in series or in parallel to the resistors. V0 generates a voltage of positive polarity white, V7 generates a voltage of positive polarity black, V8 generates a voltage of negative polarity black, and V15 generates a voltage of negative polarity white.

Figure 12:
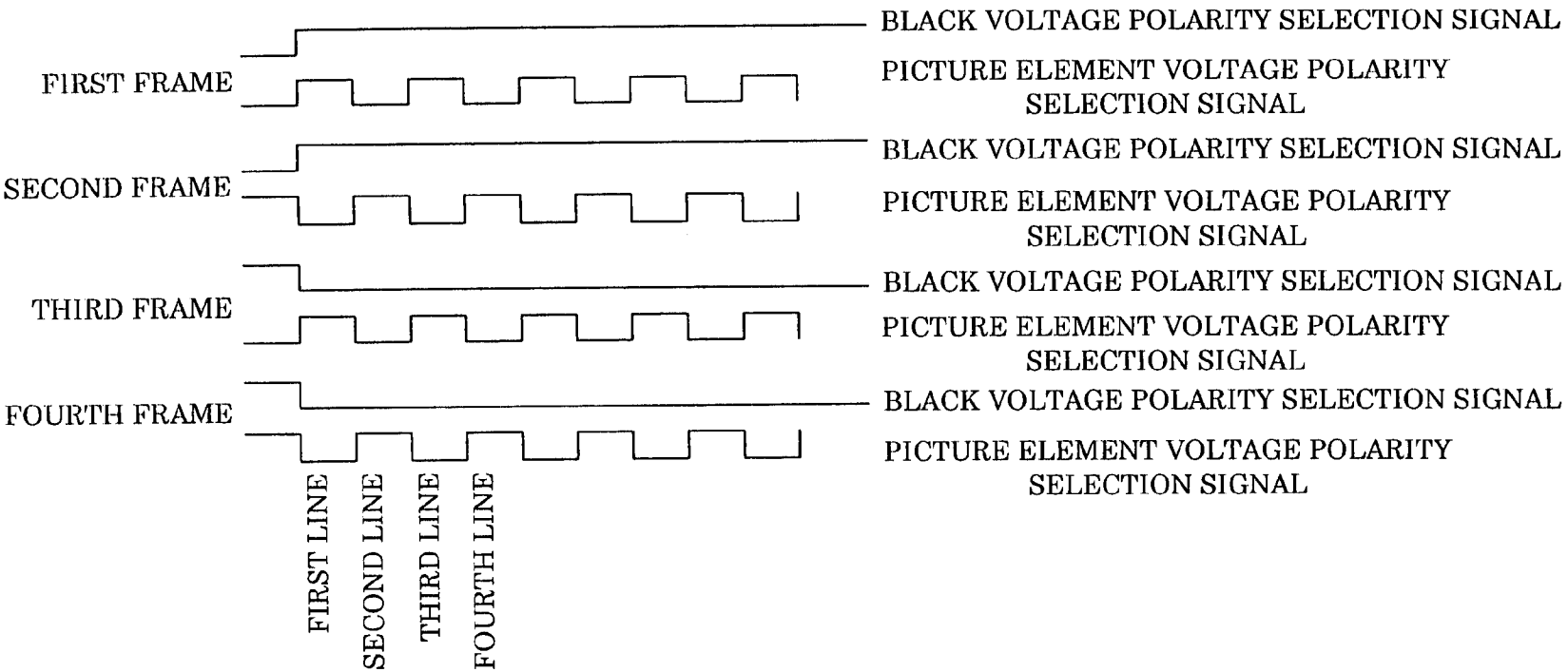
FIG. 12 is a timing chart of each signal of the liquid crystal display according to Embodiment 2 of the invention.

FIG. 12 is a timing chart of each signal of the liquid crystal display according to Embodiment 2 of the invention.

For the purpose of easy understanding, a case of interlace drive where black is displayed on every other horizontal line is hereinafter described.

FIG. 10 shows schematically an image displayed in the case where interlace drive is performed, and in which black indicates the lines where black is displayed and white indicates the lines where the image is displayed. In the case of a liquid crystal display of a driving system in which polarity of the voltage applied to the liquid crystal is changed every other horizontal line, this drive is applicable by changing the reference voltage in the same manner as in the foregoing Embodiment 1.

In the circuit arrangement of the reference voltage generator circuit of FIG. 11, connected switches are turned on and off in accordance with black voltage polarity selection signal 405. For example, if the switches are opened and closed as shown in the drawing, all the reference voltages of negative polarity are changed to black display voltages, and reference voltages of positive polarity are changed to image display voltages (a second reference voltage generation mode). If the switches are opened and closed in counter-logic, all the reference voltages of positive polarity are changed to black display voltages, and reference voltages of negative polarity are changed to image display voltages (first reference voltage generation mode).

Supposing that each of the switches is opened or closed as shown in the drawing, if the polarities of the applied voltages of the horizontal lines of odd frames are positive, negative, positive, negative, . . . in order from the top, the reference voltages of negative polarity are all fixed to black display voltages whatever data are inputted to the data line drive IC. As a result, even-numbered lines are changed to black display. In the case where the polarities of the applied voltages of the horizontal lines in the next frame are negative, positive, negative, positive, . . . in order from the top, odd-numbered lines are automatically changed to black display.

These switches are easily manufactured by separately preparing switching elements such as small signal transistors, voltages for displaying positive polarity black and negative polarity black and by switching the voltages using analog switches or the like in the same manner as in the foregoing Embodiment 1. It is also preferable to employ D/A converter likewise in the foregoing Embodiment 1.

In the state described above, the voltage applied to the liquid crystal repeats alternately positive polarity data and negative polarity black, and therefore dc voltage components are continuously applied to the liquid crystal, deteriorating the liquid crystal. To overcome this problem, as shown in FIG. 12, by switching the black voltage polarity selection signal and picture element voltage polarity selection signal for selecting the voltage to be applied to the picture elements every two frames, for example, positive polarity data, negative polarity black, negative polarity data and positive polarity black are repeated, thereby being possible to uniformly cancel the dc voltage components.

It is also preferable to change the mentioned order or switches the black voltage polarity selection signal for every horizontal line on condition that the dc voltage components are uniformly cancelled.

It is possible to use this system as it is even in the case where any signal line drive IC of a driving system, in which every adjacent picture element in a horizontal line are of different polarities, is used. In this case, black display and image display are performed alternately for every adjacent picture elements, and therefore it is possible to obtain a display capable of being visualized more finely than that in accordance with the mentioned interlace drive.

According to Embodiment 2, it is possible to establish black display on the display image for a certain period of time with a simple circuit arrangement even in the case of interlace drive. As a result, it is possible to achieve an image of high screen uniformity.

What is claimed is:

1. A liquid crystal display comprising:

a liquid crystal panel having a large number of picture elements arranged at intersections of plural selection lines and data lines;

a selection line signal output IC for outputting a selection line signal to the selection lines of said liquid crystal panel;

a reference voltage generator circuit, which comprises first resistors connected in series between two voltages and second resistors connected in series to said first resistors, generates plural reference voltages from respective connection points of the first resistors, switches over the reference voltage either to an image display voltage or to a black display voltage, and outputs the switched reference voltage to plural wiring lines connected to the connection points; and a signal line drive IC, to which an image data signal and the reference voltage are inputted, and which outputs a voltage based on the reference voltage and the image data signal, to a data line of the liquid crystal panel, wherein the reference voltage generator circuit has a switch section which is opened and closed by a black voltage selection signal, and the switch section has first switching element arranged in parallel to the first resistors so as to open and close between a connection point for generating a black voltage and a connection point for generating a white voltage among the plural image display voltages, and second switching element which is arranged so as to control resistance values of the second resistors and output value of which has opposite polarity to output value of the first switching element, and outputs a black display voltage to the plural wiring lines by turning the first switching element into closed states, and turning the second switching element into opened states, on the basis of the black voltage selection signal to short-circuit between the connection points and to change resistance values of the second resistors, and the signal line drive IC outputs a black write voltage to the data line on the basis of the black display voltage, and the switch section includes an image display period for supplying said image display voltage and a black display period for supplying the black display voltage in one horizontal period, and is switched over by the black voltage selection signal, so as to be synchronized with a change of a selection line signal in a row of the selection line for writing an image therein and a row thereof for writing black therein.

2. The liquid crystal display according to claim 1, wherein when said selection line signal output IC drives nG selection lines and a selection line clock period TH is used for driving said selection lines, a signal, which makes the output of said selection line signal output IC valid when said reference voltage is switched to the image display voltage while making the output of said selection line signal output IC invalid when said reference voltage is switched to the black display voltage, is inputted to said selection signal output IC during nGTH period from input of a start pulse, and an inverted signal of said signal is inputted after the nGTH period.

3. The liquid crystal display according to claim 1, wherein said reference voltage is switched from the black display voltage to the image display voltage at time T1 and switched from the image display voltage to the black display voltage at time T2, said selection line signal output IC outputs the selection line signals so that the lines of the selection lines selected at time (T2−T1)/2+T1 are changed to a non-selective state at a time later than (T2−T1 )/2+T1 and earlier than T2.

4. The liquid crystal display according to claim 1, wherein said reference voltage is switched in a period during which no image data is loaded in said signal line drive IC.

5. The liquid crystal display according to claim 1, wherein said reference voltage is switched during a period when image data are loaded in said signal line drive IC.

6. The liquid crystal display according to claim 1, wherein the switch section is formed by analog switches.

7. A liquid crystal display comprising:

a liquid crystal panel having a large number of picture elements arranged at intersections of plural selection lines and data lines;

a selection line signal output IC for outputting a selection line signal to the selection lines of said liquid crystal panel;

a reference voltage generator circuit, which comprises first resistors connected in series between two voltages and second resistors connected in series to said first resistors, generates plural reference voltages from respective connection points of the first resistors, and outputs them to plural wiring lines connected to the connection points as image display voltages, and a signal line drive IC, to which an image data signal, a control signal and the reference voltage generated by the reference voltage generator circuit are inputted, and which outputs an image write voltage based on the image display voltage, to a data line of the liquid crystal panel, wherein the reference voltage generator circuit has a switch section which is switched over, by a black voltage polarity selection signal, either to a first reference voltage generation mode in which the black display voltage is always generated under positive polarity and the image display voltage is generated under negative polarity or a second reference voltage generation mode in which the black display voltage is always generated under negative polarity and the image display voltage is generated under positive polarity, and the switch section has first switching element arranged in parallel to the first resistors so as to short-circuit a connection point for generating a black voltage and a connection point for generating a white voltage among the plural image display voltages, and second switching element which is arranged so as to control resistance values of the second resistors and output value of which have opposite polarity to output value of the first switching element, and outputs a black display voltage to the plural wiring lines by turning the first switching element into closed states, and turning the second switching element into opened states, on the basis of the black voltage selection signal to short-circuit between the connection points and to change resistance values of the second resistors, on the basis of the black selection signal, in the positive polarity and negative polarity respectively, and the signal line drive IC outputs a black write voltage to the data line on the basis of the black display voltage, and the first reference voltage generation mode and the second reference voltage generation mode are alternatively switched over every vertical period by the black voltage polarity selection signal, so that said image write voltage or said black write voltage is outputted during one vertical period, about the picture element

8. The liquid crystal display according to claim 7, wherein said reference voltage generator circuit is comprised of resistors connected in series, and said resistance values are changed by switching elements connected in series or in parallel to said resistors.

9. The liquid crystal display according to claim 7, wherein said reference voltage generator circuit is comprised of a semiconductor device capable of inputting a digital signal, and a voltage of an arbitrary value is generated conforming to said digital signal.

* * * * *